United States Patent [19]

Raville

[11] 4,031,808

[45] June 28, 1977

[54] HANDGUN APPARATUS

[76] Inventor: Clarence A. Raville, P.O. Box 377, Thousand Oaks, Calif. 91360

[22] Filed: Aug. 7, 1975

[21] Appl. No.: 602,566

Related U.S. Application Data

[62] Division of Ser. No. 343,560, March 21, 1973, Pat. No. 3,901,125.

[52] U.S. Cl. ..... 89/163

[51] Int. Cl.² ..... F41D 11/06

[58] Field of Search ..... 89/163

[56] References Cited

UNITED STATES PATENTS 3,241,449 3/1966 Dwyer ..... 89/163

OTHER PUBLICATIONS

Jorgensen et al., American Rifleman, "Rear Lock-Up Stabilizes .45 Pistol", vol. 117, No. 8, Sept. 1969, p. 41.

*Primary Examiner*—Stephen C. Bentley
*Attorney, Agent, or Firm*—Robert E. Geauque

[57] ABSTRACT

The apparatus of this invention relates to certain improvements in a handgun which is generally known as "Colt Government Model Automatic Pistol, Caliber .45." Basically the aforementioned handgun has a handgrip housing to which a trigger is connected, a barrel which is connected through a pivoting link to the trigger housing, a slide movably mounted upon the barrel between a cartridge firing position and a cartridge ejection position, the barrel pivoting slightly during the movement of the slide, the link which connects the barrel to the trigger housing including an eccentric sleeve so as to permit adjustment of this pivoting movement of the barrel, the barrel including a transverse opening communicating with the firing chamber so as to permit observance of a cartridge located in the chamber when the slide is in the cartridge firing position, a bushing assembly supporting the outer end of the barrel in a press fitting manner so as to tightly hold the barrel in position during firing, a recoil absorber assembly located between the trigger housing and the slide which employs absorption of energy by an air chamber, by a spring and by a pillow of a resilient material.

6 Claims, 12 Drawing Figures

Fig. 7.
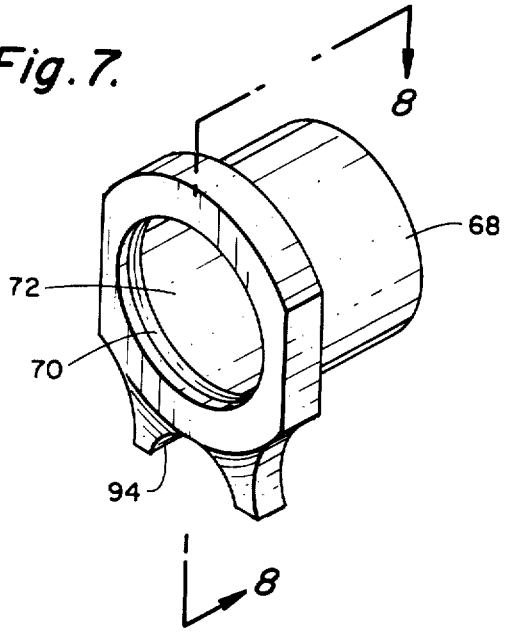
Fig. 8.
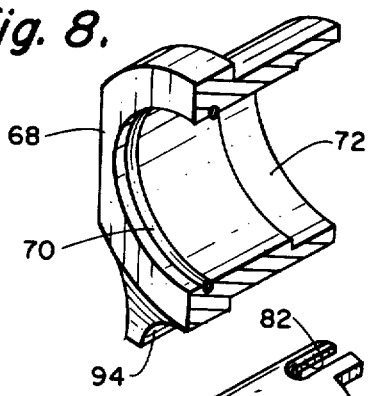
Fig. 9.
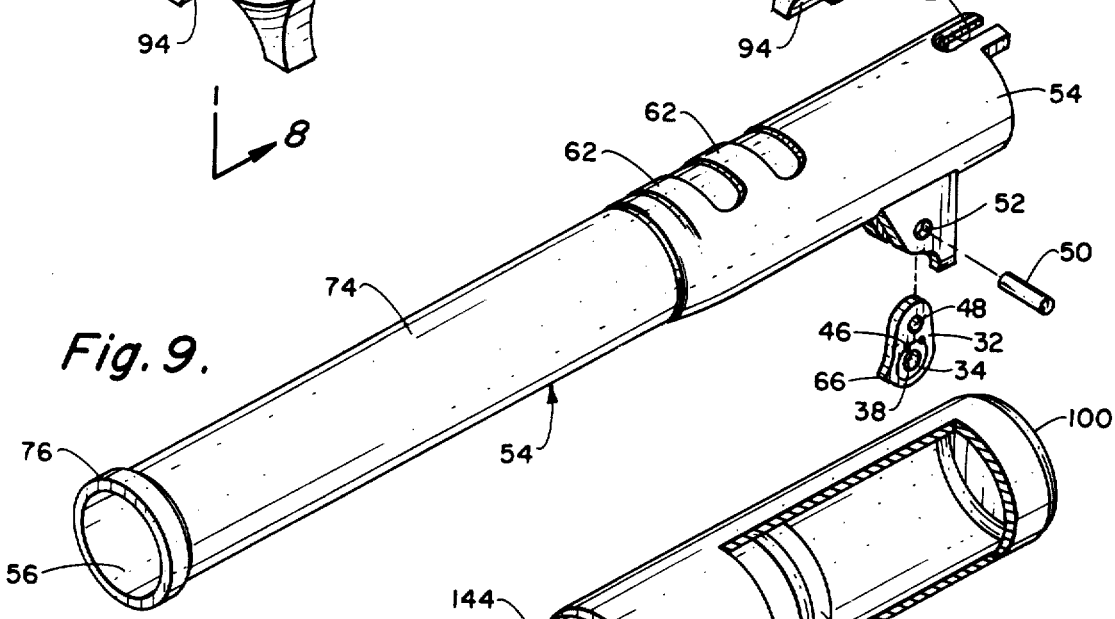
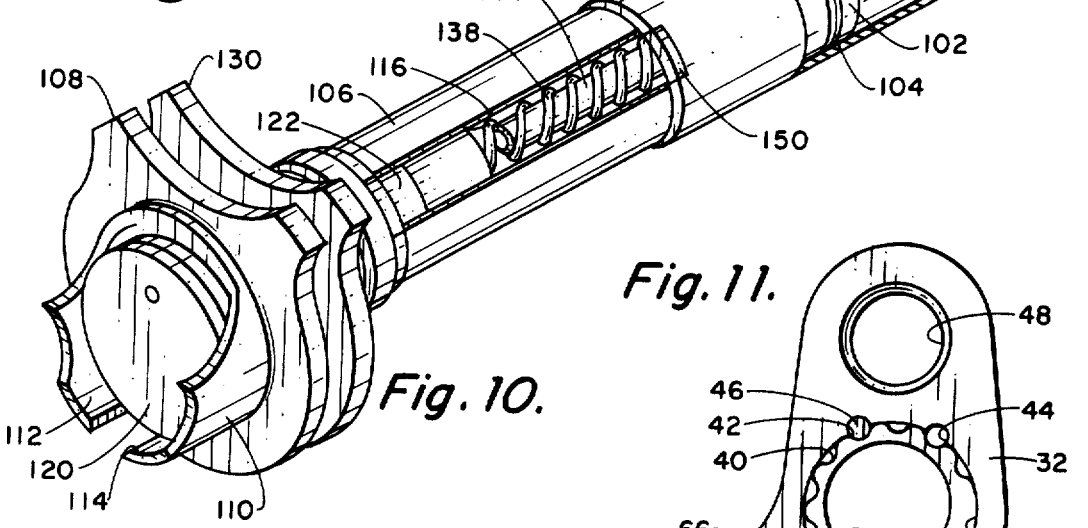
Fig. 10.
Fig. 11.
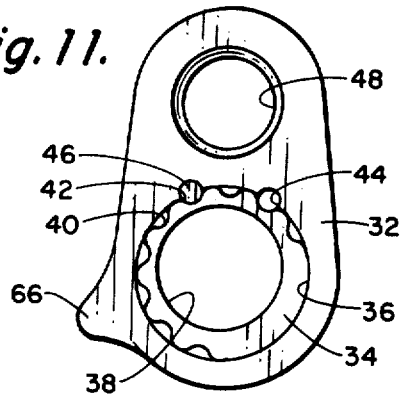

HANDGUN APPARATUS

This is a division of application Ser. No. 343,560 filed Mar. 21, 1973, now U.S. Pat. No. 3,901,125.

BACKGROUND OF THE INVENTION

The field of this invention relates to firearms and specifically to the handgun type of firearm. The subject matter of this invention is related to the structure defined and claimed within U.S. Pat. No. 3,656,249, entitled "Double Action Hand Gun Apparatus," issued Apr. 18, 1972, by the present inventor.

The main advantage to a .45 caliber firearm is that due to the large mass of a .45 caliber bullet and the relatively low propelling velocity, if the bullet strikes a human being, even in a limb, the person would more than likely be knocked off balance and down. Clearly, the use of such a handgun is of particular advantage in war and also law enforcement. The lower caliber firearms that are presently being employed in the Armed Services and law enforcement employ the use of a substantially lower mass bullet (compared to the .45 caliber bullet) which is propelled at substantially greater velocity (compared to the .45 caliber bullet). Frequently, when a person is struck with such a lower caliber bullet, the bullet passes quickly through the person with the momentum of the bullet not being transmitted to the person. In both the Armed Services and law enforcement, one of the major complaints is that the person that has been struck continues to navigate about, still representing the same danger as before being struck. As a result, the military individual or the law enforcement officer finds it necessary to shoot the individual a plurality of times before the party becomes inoperative. Besides the danger to the party of several wounds, it is also dangerous to the shooter in that the struck party can continue to return the fire. It would be in the best interest of both parties for the struck party to be rendered inoperative with one shot.

Although the .45 caliber handgun, due to its "knocking down" power, would be especially suited for law enforcement use, even the best marksman of such a weapon is relatively inaccurate at greater than 50 feet. This is due to the fact that the basic construction of this type of handgun produces such inaccuracies. The barrel of such a handgun is actually permitted to move a few thousandths of an inch during firing and is not held rigid. A few thousandths of an inch movement of the barrel easily results in a several inch movement of the projectile at 50 feet. Additionally, the recoil of a conventional .45 weapon is substantial and usually the handgun, when fired, moves several inches in the upward direction. If a second shot is needed, it is then required for the shooter to completely re-aim the handgun which is undesirable through the loss of time required to do such re-aiming.

In both law enforcement and the military, the use of a .45 caliber weapon is highly desirable over a smaller caliber weapon such as a .38 caliber. However, the inherent deficiencies of the aforementioned Colt .45 Semi-Automatic Pistol have prevented its widespread use because a .38 caliber is definitely more accurate and does not have an undesirable amount of recoil. If the aforementioned .45 caliber handgun could be modified so as to have a recoil substantially equal to that of the .38 caliber weapon, and the handgun be constructed so as to be substantially more accurate, it would be definitely advantageous for law enforcement officers and the military to choose the use of such a weapon over a .38 caliber handgun.

An additional disadvantage of the aforementioned Colt handgun is that there is no way to tell if a cartridge is in the firing chamber with the exception of moving the slide toward the cartridge ejection position. At certain times it is desirable to know quickly if a cartridge is in the chamber so the operator then knows not to cock the weapon and at other times he may believe that there is no cartridge in the chamber when in reality there is. In such instances accidents frequently happen. It would be desirable to employ some means that would make readily observable to the operator whether or not a cartridge is located within the chamber.

SUMMARY OF THE INVENTION

The apparatus of this invention is to be employed in combination with a handgun which is classified as semi-automatic wherein, upon the firing of the handgun, a slide is caused to be moved rearwardly with respect to the barrel and eject the spent cartridge and then place a new cartridge within the firing chamber of the barrel. The barrel is to include a transverse opening in the area of the firing chamber so a person can readily observe whether a cartridge is positioned in the firing chamber without moving the slide toward the cartridge ejection position. The barrel within this type of handgun is permitted to move a few thousandths of an inch with the remaining portion of the handgun, with the barrel including locking lugs which are to be moved into locking recesses within the slide when the handgun is in the cartridge firing position. As the slide is moved to the cartridge ejection position, the barrel is moved out of cooperation with the locking recesses so as to permit the slide to be movable in respect to the barrel. In the conventional handgun of this type, this barrel is still permitted to move slightly even during firing and this few thousandths of an inch of movement of the barrel makes the conventional handgun of this type inherently inaccurate. In this invention a bushing assembly is employed which rigidly holds the barrel in a fixed position when the cartridge is fired. Also the bushing assembly holds the locking lugs tightly into engagement with the locking recesses so as to avoid any "hammering effect" during firing which can cause premature wear within the handgun. The barrel is pivotally connected to the trigger housing through a link. Within this invention the link is made to be adjustable so that the pivoting movement of the barrel with respect to the slide can be controlled so that when the barrel is in the firing position, the locking lugs of the barrel are in tight complete engagement within the locking recesses of the slide. A recoil absorber assembly is located between the slide and the trigger housing so that the recoil of the gun is completely absorbed and is not transferred to the operator of the weapon. The recoil absorber assembly damps the recoil energy through the use of an air cushion, a spring cushion and a resilient rubber cushion.

Some of the advantages of the apparatus of this invention which have not been specifically enumerated previously are as follows: Substantially decreases the amount of recoil, therefore permitting rapid firing of successive rounds with greater accuracy. Also, by significantly diminishing the recoil, the operator of the handgun tends to not physically tire as easily and also the muscles of the operator of the gun do not become sore from firing a substantial number of rounds in a short period of time. Additionally, by eliminating the "play" of the barrel within the handgun, the accuracy of the handgun itself is substantially improved. Further, the apparatus of this weapon minimizes the wear of the parts of the handgun which therefore significantly increases the life of the handgun. A significant advantage of the structure of this invention is that the average gun owner in a few minutes, without alterations or special tools, can install the structure of this invention within his own gun. Further, by incorporating the improvements of this invention within what can be termed an old and worn handgun, causes such a gun to be completely revitalized so as to be better than a new gun which does not include improvements of this invention and in fact brings the old gun up to the standard of a new gun including the improvements of this invention. A still further improvement of the structure of this invention is that the bushing assembly included within this invention protects the end of the barrel from dust, dirt, water and other foreign particles and also if the handgun is accidentally dropped, the end of the barrel is protected against damage. A further advantage of the structure of this invention is that upon ejecting the cartridges, it is found that each cartridge is ejected with substantially less force and as a result, the spent cartridges are located in close proximity to the shooter with the cartridges being located directly adjacent one another. This is desirable when it is desired to reload these cartridges. Another advantage of the structure of this invention is that with the weapon in the battery position (ready for firing), the recoil absorber apparatus within this invention doubles the force of the ordinary recoil spring (12 pounds vs. 6 pounds) and employs this force to retain the locking lugs of the barrel in tight engagement with the locking recesses in the slide. This allows the projectile to travel further down the barrel (twice as far) before the slide begins to move to the unlocking position (out of battery). As a result, a greater accuracy of the weapon is achieved by permitting the projectile to move farther on its path of flight before the barrel is pivoted with respect to the slide. Also, this feature permits the use of a heavier projectile without the danger of premature unlocking. It is to be noted that a further feature of this invention is that this 12 pound force occurs only at the beginning of recoil, and after recoil gets beyond the initial stages, the conventional 6 pound force is employed to absorb its portion of the energy of the recoil of the weapon.

BRIEF DESCRIPTION OF THE DRAWINGS

FIG. 7 is an isometric view of the novel barrel bushing assembly which is employed within this invention;

FIG. 8 is a cross-sectional view through the bushing assembly of this invention taken along line 8—8 of FIG. 7;

FIG. 9 is an exploded isometric view of the barrel assembly employed within this invention and its connecting link assembly.

FIG. 10 is an isometric view of the recoil absorber assembly which is employed within this invention;

FIG. 11 is an enlarged view of the novel link which is employed to connect the barrel to the trigger housing within this invention.

DETAILED DESCRIPTION OF THE SHOWN EMBODIMENTS

Figure 1:
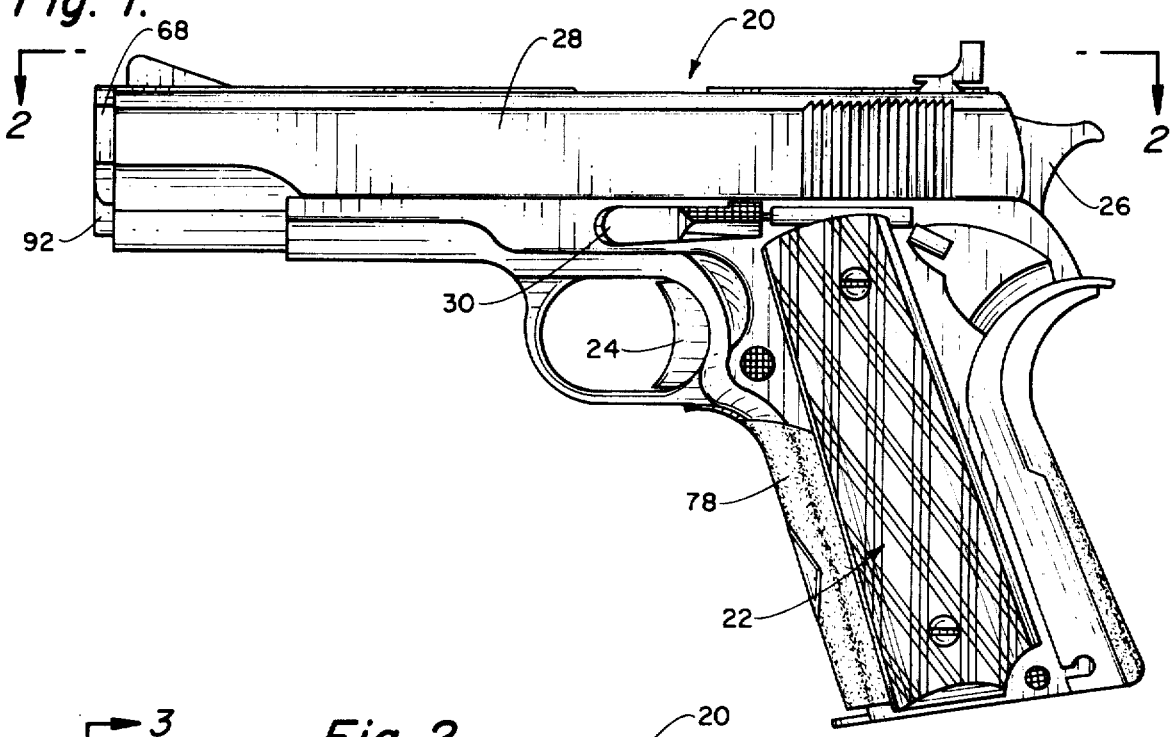
FIG. 1 is a front view of a handgun within which the improvements of this invention have been employed.

Referring particularly to the drawing, there is shown in FIG. 1 a handgun 20 that is composed primarily of a trigger housing 22 to which is connected a movable trigger 24 which is to be manually activated to move hammer 26 to effect firing of the handgun. A slide 28 is movably mounted upon the trigger housing by means not shown. This type of handgun is basically similar to the Colt Government Model Automatic Pistol, Caliber .45 and reference is to be had thereto for any details of construction or operation of the particular type of handgun.

Connected by a pivot pin 30 to the trigger housing 22 is a link 32. The link 32 includes a sleeve 34 located within an opening 36 in the link 32. The sleeve 34 includes an opening 38 located therethrough and it is noted that the location of the opening 38 is eccentric to the peripheral edge of the sleeve 34. The pivot pin 30 is to be conducted through opening 38.

The outer periphery of the sleeve 34 includes a plurality of notches 40. The notches 40 are spaced apart in a closely spaced apart manner. Also included within the link 32 are a pair of spaced apart pin apertures 42 and 44. A pin 46 is capable of being inserted within one of the apertures 42 or 44 and is to cooperate with one of the notches 40. Also located within the link 32 is an opening 48. Opening 48 is to establish a loose fit with a pivot pin 50 which is located through an opening 52 in a portion of the barrel 54. The barrel 54 includes a central elongated bore 56 through which the projectile 48 of the cartridge 60 is to be fired.

Figure 2:
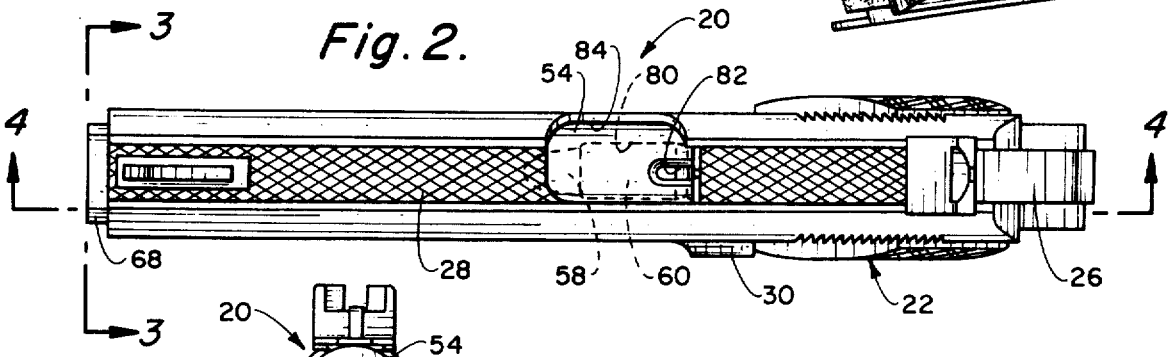
FIG. 2 is a top view of the handgun of this invention taken along line 2—2 of FIG. 1.
Figure 3:
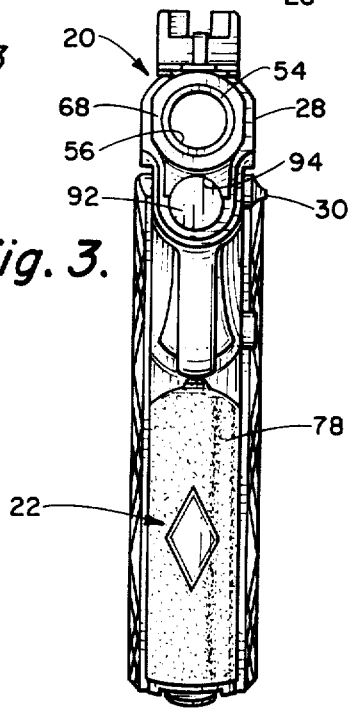
FIG. 3 is a front view of the handgun of this invention taken along line 3—3 of FIG. 2.
Figure 6:
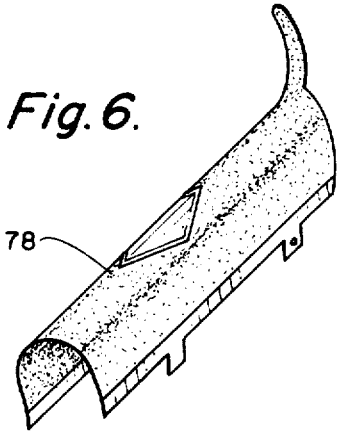
FIG. 6 is an isometric view of a friction grip which is to be attached to the trigger housing of the handgun within this invention which facilitates the operator of the handgun to grasp the handgun tightly.
Figure 4:
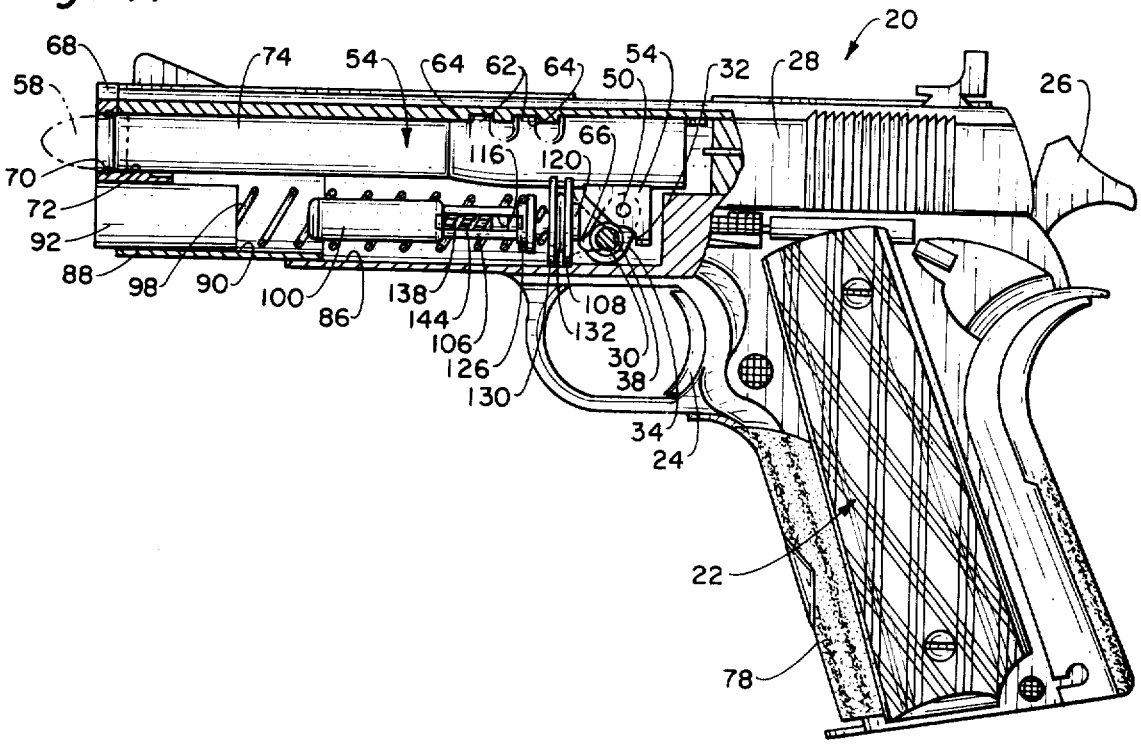
FIG. 4 is a cross-sectional view of the handgun of this invention taken along line 4—4 of FIG. 2.

Located upon the exterior surface of the barrel 54 is a plurality of spaced apart locking lugs 62. Located within the interior of the side 28 is a plurality of spaced apart locking recesses 64. With the handgun in the cartridge firing position shown in FIGS. 1, 2 and 4 of the drawings, the locking lugs 62 matingly cooperate within the locking recesses 64. In this position the link 34 is in a substantial upright position as shown in FIG. 4. It is desirable to have the locking lugs 62 to fully cooperate within the locking recesses 64 because the primary component of the recoil force is being transmitted in the aft direction through the barrel 54 through the locking lugs 62 and into the slide 28 through the recesses 64. By manually selecting the position of the sleeve 34 within link 32, the amount of movement of the locking lugs 62 to within the recesses 64 can be controlled to some extent. Once the full complete cooperation of the lugs 62 within the recesses 64 is attained, the operator places a pin 46 within the either aperture 42 or 44 and cooperates such with the particular notch 40 within the sleeve 34. This position is then permanently established and should not again need to be altered. Once the pin 46 is placed within its particular aperture 42 or 44, such installation is accomplished in a permanent manner and it is not envisioned that it will ever need to be removed.

The link 32 also includes a protuberance 66 on its forward edge thereof. The function of this protuberance 66 will become more apparent further on in the description.

It has been found that by the employment of two separate apertures 42 and 44 and by employing a series of spaced apart notches 40, as small as a 6° variation can be obtained. Each six degrees of variation results in an extremely small amount of movement (only a few thousandths of and inch) of the locking lugs 62 to within the locking recesses 64. However, this is all the amount of movement that is necessary to eliminate the amount of play between the barrel 54 and the slide 28. It has been found that such play occurs not only in used or well worn handguns but also in new handguns.

Fixedly positioned by means not shown within the slide 28 at its forward end thereof is a bushing assembly which includes an outer bushing 68 and an inner bushing 70. The inner bushing 70 is mounted within the outer bushing 68 and has an opening size of slightly less (few thousandths of an inch) than the opening 72 within the outer bushing 68. The barrel 54 includes a necked down section 74 which extends a substantial portion of the length of the barrel adjacent the locking lugs 62 to almost the forward edge of the barrel. The forward edge of the barrel is slightly enlarged to form an enlarged portion 76. For purposes of description in the drawing, this enlarged portion 76 is accentuated.

The inner bushing 70 will be normally constructed of a rigud plastic material having low friction or an oily characteristic. An example of such a material is plastic which is commonly sold under the trade name of "Teflon."

Figure 5:
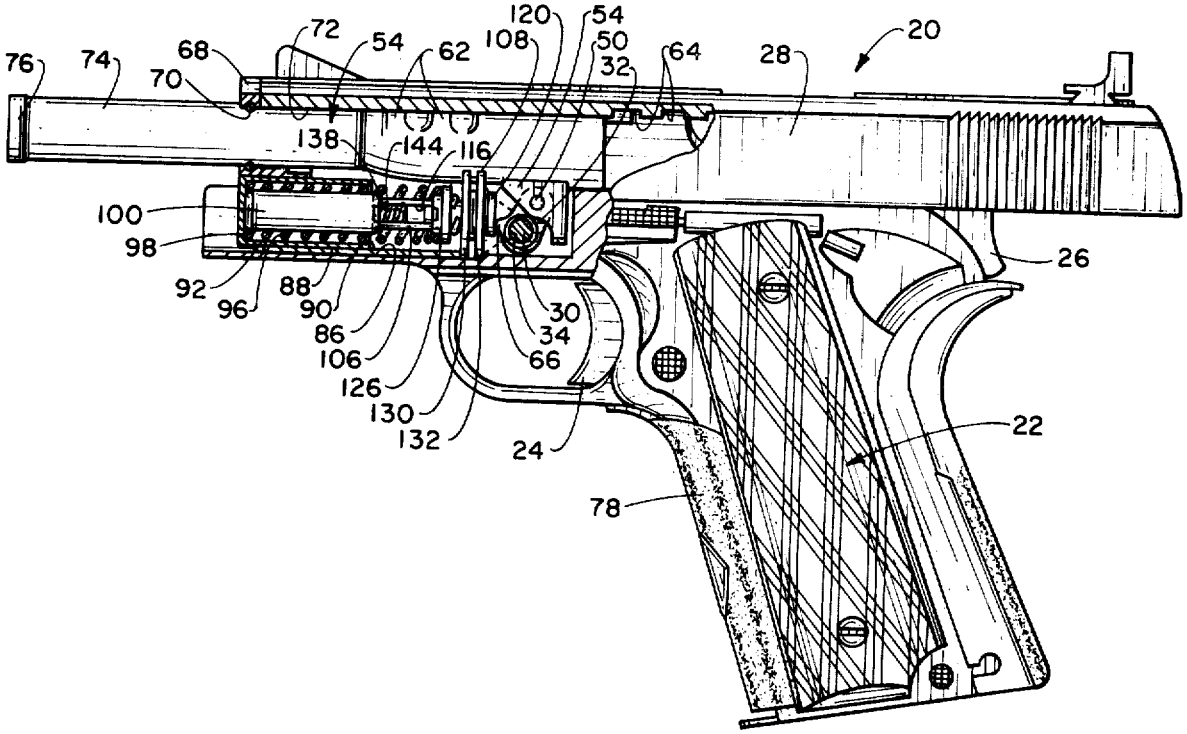
FIG. 5 is a cross-sectional view similar to that of FIG. 4 but showing the slide in the aft position or the cartridge ejection position.
Figure 12:
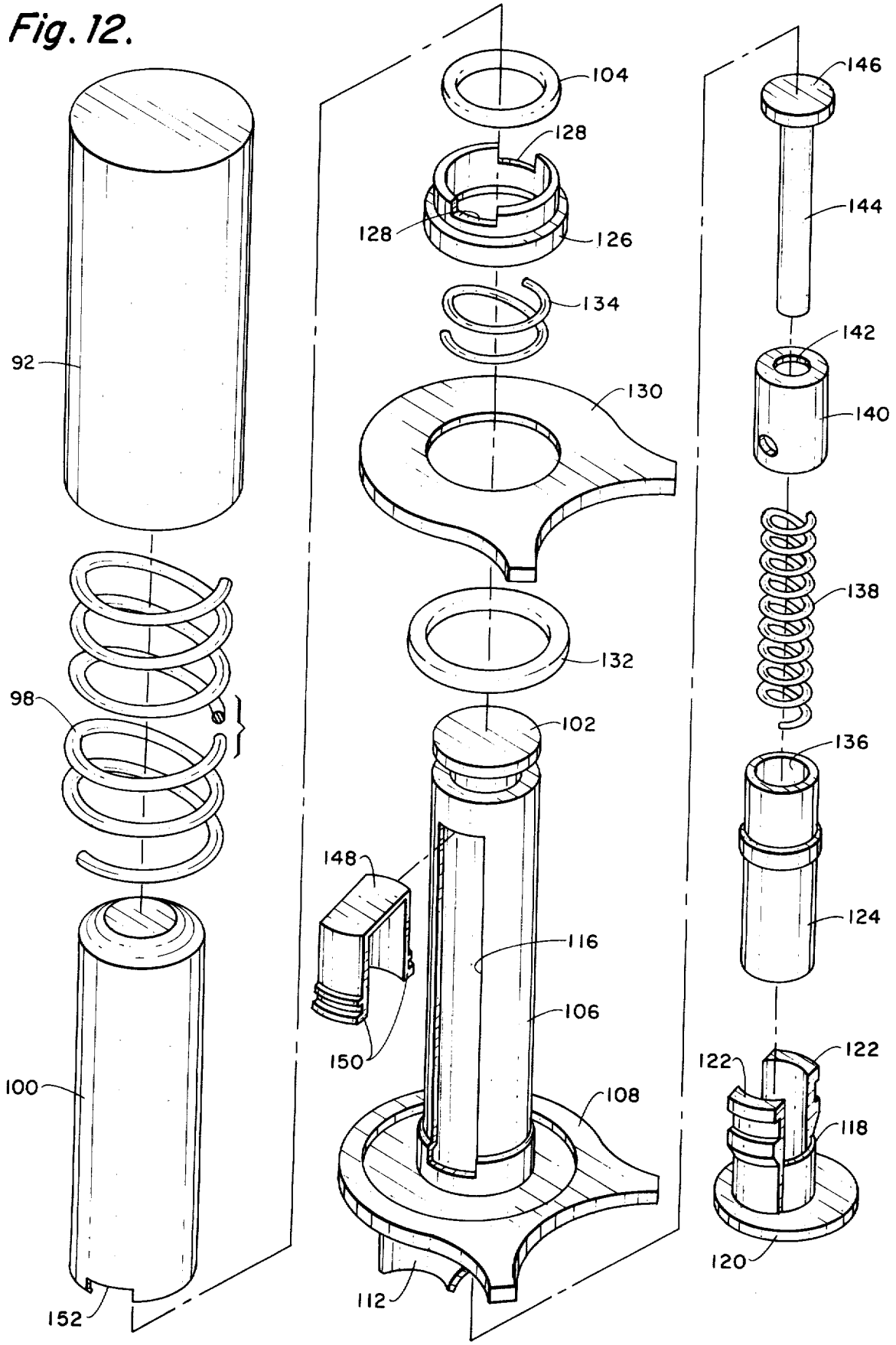
FIG. 12 is an exploded isometric view of the recoil absorber assembly employed within this invention.

When the slide 28 is in the position shown in FIG. 5 of the drawings, the inner bushing 70 is located within the necked down section 74 and is free to slide thereupon. However, when the slide 28 is in the position shwon in FIG. 4 of the drawings, that is, in the cartridge firing position, a press fit relationship is established between the inner bearing 70 and the enlarged portion 76. Actually, the opening size within the inner bearing 70 is slightly less than the circumference of the enlarged portion 76. As the slide 28 is moved forward from the position of FIG. 5 to FIG. 4, and the inner bearing 70 comes into contact with the enlarged portion 76, a certain pulling action occurs with the slide 28 tending to pull the barrel 54 forwardly. At the same time, because of the pivoting of the link 32, the barrel 54 is caused to pivot upwardly so that the locking lug 62 will cooperate within the locking recesses 64. Because of this pulling action of the inner bearing 70, complete cooperation of the locking lugs 62 within the recesses 64 is assured and also that the forward edge surface of each of the locking lugs 62 is pressed against the aft edge surface of the locking recesses 64. When the handgun is fired, because a solid physical contact occurs between the edges of the locking lugs 62 and their locking recesses 64, a direct transmission of forces therebetween will occur and there will be no hammering effect which would occur if there was a slight amount of play therebetween. It has been found that if a slight amount of play is permitted, this hammering effect will cause excessive wear within a very short period of time and may require replacement or repair of the barrel and/or slide.

It is further to be noted that each time the slide 28 is moved forward into the cartridge firing position shown in FIG. 4, the barrel 54 is held in this position by the bushing assembly in a rigid manner so that when the cartridge 60 is fired, as the projectile 58 moves through the bore 56, there will be no wobble of the barrel 54. This barrel wobble, which is inherent in handguns of this type prior to this invention, causes the projectile 58 to be fired with a low degree of accuracy. Therefore, by the inclusion of the bushing assembly of this invention, a higher degree of accuracy of achieved and that actually a relatively inaccurate weapon has been transformed into a relatively accurate weapon.

It has been found to be desirable to include a "nonslick" surface on the forward edge of the trigger housing 22. For this purpose a grip plate 78 is to be attached to the trigger housing as shown in the drawings. This grip plate 78 is formed of an anodized metal surface which is roughened to form somewhat of a serrated surface. This grip plate may also be personalized such as putting the owner's name or initials thereon to denote the owner of the particular handgun.

With the normal type of barrel 54 which is employed in the conventional handgun of this invention, when the slide 28 is in the cartridge firing position shown in FIG. 4, there is no way to tell if there is a cartridge within the firing chamber 80 without moving back the slide 28. A window 82 which comprises a longitudinal slot is formed within the barrel 54 and communicates with the firing chamber 80. The location of the window 82 is such that it connects with the cartridge ejection opening 84 formed within the slide 28. A portion of the cartridge 60 will show through the window 82 so that the one operating the handgun may quickly by observing through the window 82 know whether a cartridge 60 is located within the firing chamber 80 without having to move the slide 28 in a rearward direction.

Located within the trigger housing 22 is a recoil chamber 86. A hollow extension 88, which has an opening 90 formed therein, is integrally secured thereto and forms a pair of the slide 28. This extension 88 is adapted for longitudinal movement within the recoil chamber 86. A plug 92 is located within the opening 90 in a close fitting manner with the forward end of the plug 92 to cooperate within the recess 94 formed within the outer bushing 68. The outer configuration of the plug 92 is tapered so that the smallest taper dimension is at the front edge of the plug 92. This tapering is not substantial, it only being envisioned about six degrees as adequate. The purpose of the tapering 92 is that, as will become apparent from the following, as the plug 92 is forced outwardly into engagement with the outer bushing 68 within the recess 94, the dimension of the recess 94 is closely configured to the outer configuration of the plug 92 and this slightly tapering 92 forms an extremely tight snug fit between the plug 92 and the bushing 68. This further results in the bushing 68 being held in an extremely rigid manner, not permitting the bushing 68 to even slightly rotate with respect to the slide 28. This further causes the handgun of this invention to become a more accurate weapon.

The plug 92 is substantially hollow forming an interior opening 96. A recoil spring 98 is to be located within the opening 96. Spring 98 is deemed to be conventional in configuration and is employed in the conventional type of handgun. This recoil spring normally has a force of approximately 6 pounds per inch.

The recoil spring 98 also surrounds a cylinder 100 of a recoil absorber assembly. Cylinder 100 is conventionally hollow and is closed at its outermost end but does have one end open. Through the open end is conducted a piston 102. An O-ring seal 104 is located about the piston 102 and is to form a substantially airtight seal between the piston 102 and the inner wall of the cylinder 100. The piston 102 is connected to a rod 106 which is fixedly connected to a plate 108. The outer surface of the plate 108 is adapted to come into physical contact with a portion of the trigger housing 22. Aligning elements 110 and 112 are connected to the plate 108 and are to extend forward around a portion of the link 32. The link 32 is to be movable in the slot 114 located between the elements 110 and 112.

The rod 106 is shown to be substantially hollow and includes on each side thereof diametrically opposed slots 116. An inner piston which has a piston had 120 is movably mounted in the hollow opening within the rod 106. The inner piston 118 includes a pair of diametrically spaced apart fingers 122.

A connecting rod 124 is to be locatable within the fingers 122 and tends to bias such radially outward. A ring 126 is to be locatable about the rod 106 with the recesses 128 formed within the ring 126 to connect with the fingers 122. Because the rod 124 is located interiorly of the fingers 122 and the fingers 122 are always biased outwardly into engagement with recesses 128, such will always be maintained in continuous engagement unitl it is desired to take the elements apart manually.

Another plate 130 is to surround the rod 106 and be located in close proximity to plate 108. A ring of resilient material 132 is to be located between the plates 108 and 130. This pillow of resilient material produces a certain amount of energy damping characteristic. Such resilient material can be a sponge rubber or the like.

A small spring 134 is located between the plate 130 and the ring 126. The function of the spring 134 is to exert a constant small bias against the ring 26 tending to move such in a direction so that the piston head 120 is held in abutting contact with the plate 108. However, it will become more apparent further on in the description that once the recoil apparatus of this invention is installed within the handgun, the piston head 120 will be displaced away from the plate 108. The piston head 120 is to be in continuous contact with the protuberance 66 of the link 32. As the link 32 is pivoted within the handgun, the piston head 120 will be moved inwardly and outwardly with respect to the plate 108.

Located within the hollow opening 136 formed within the rod 124 is a coil spring 138. A cap 140 is to cover the free end of the coil spring 138 and includes an opening 142 formed therein for a pin 144 to pass therethrough. The head 146 of the pin 144 is to be located within the bifurcated member 148 which includes a pair of diametrically spaced apart fingers 150. The head 146 functions to bias radially outwardly the fingers 150 into engagement with appropriate recesses 152 formed within the cylinder 100. In this manner, as long as the head 146 is positioned within the member 148 and the fingers 150 are biased outwardly, the members 144, 148 and 100 will be connected together into a single unit. The member 148 fits within the slot 116 of the rod 106.

The operation of the recoil absorber apparatus located within this invention is as follows: Let it be assumed that the handgun 20 is in the cartridge firing position shown in FIG. 4 of the drawing. Prior to firing of the cartridge, the 6 pound force of the recoil spring 98 is transmitted through the ring 126, through the fingers 122 to the inner piston 118 and to the inner piston head 120. Inner piston head 120, as previously mentioned, is in continuous contact with the protuberance 66 of the link 32. With the link 32 in the position shown in FIG. 4 of the drawings, a torque is created about the pin 30 which is actually in excess of the force of the spring 98. In actual practice it has been found that this force is approximately double the size of the spring force, that is, twelve pounds. This means that there is a double force tending to maintain the locking lugs 62 into full cooperation with the locking recesses 64.

When the cartridge is fired and as the projectile 58 moves down the bore 56, at some point in time the recoil force is built up sufficiently to overcome this 12 pound force located on the link 32. At this particular point in time, it is hopeful that the projectile 58 is located just at the end of the bore substantially in the position shown in FIG. 4 of the drawings. From thereon, as the barrel is moved, this barrel movement will not be transferred to the projectile 58 so as to cause the projectile to fly untrue to its target.

When the recoil force is sufficient to overcome the twelve pound force created through the spring 98 and the location of the protuberance 66, the slide 28 is forced to move in a rearward direction. This rearward direction, due to the cooperation between the lugs 62 and the recesses 64, causes the barrel 54 to pivot slightly downwardly with respect to the slide until the locking lugs 62 are taken out of cooperation with the recesses 64. When this occurs the slide 28 is then free to move in the aft direction with respect to the barrel 54. At this particular time, because the protuberance 66 has been moved with respect to the piston head 120, no longer a 12 pound force is being transmitted and just the conventional 6 pound force is now being transmitted to the link 32.

As the slide 28 continues to move in the rearward direction, the inner bushing 70 of the bushing assembly is taken out of its press fit relationship with the enlarged portion 76. Also, the protuberance 66 has been moved to a position shown in FIG. 5 of the drawings wherein the 6 pound force of the recoil spring is transmitted through the link 32 so as to create a torque about the pin 30 in substantially the opposite direction tending to hold the barrel 54 in its downwardly pivoted position. In other words, because of the inclusion of the protuberance 66, a positive superior locking arrangement is achieved to hold the barrel in the down position when it is in the down position while at the same time tending to hold the barrel more positively in the up position when it is in the up position.

As the slide 28 continues to move in a rearward direction and the recoil spring 98 is compressed, at a certain amount of movement, the end of the cylinder 100 will come into contact with the end of the opening 96 located within the plug 92. At this point a compressing of the cylinder with respect to the piston 102 occurs and the air located in the chamber within the cylinder 100 is compressed. The greater amount of compression, the greater amount of the resisting force and the greater amount of energy absorbed. The length of the recoil absorber assembly is selected so that the cylinder 100 will not contact the end of the opening within the plug 92 until the slide 28 has moved sufficiently in the aft direction so as to eject the spent cartridge and then pick up the new cartridge ready for insertion within the firing chamber. At that particular point it is desirable to absorb as much of the recoil as fast as possible so as to minimize the recoil force which is transmitted to the shooter of the handgun. Previously, with the conventional type of handgun, the remaining recoil energy would be transmitted directly to the hand of the operator which would cause the hand of the operator to move substantially away from the line of target.

As energy is absorbed within the air chamber located within the cylinder 100, the coil spring 98 is also absorbing a portion of the recoil energy. Because of the resilient pad of material 132 located between the plates 130 and 108, an additional energy absorption medium is provided. In actual practice, it has been found that no matter what amount of recoil force is produced, in no way will there be a direct metal to metal contact and that the combination of the air chamber, the recoil spring, and the resilient pad of material 132 sufficiently absorbs the entire amount of recoil energy without there being any metal to metal contact of the slide with the trigger housing.

When all of the recoil energy has been absorbed, the force of the recoil spring 98 then causes the slide 28 to be moved in the forward direction until the handgun assumes the position shown in FIG. 4 of the drawings. In this position a cartridge has now been replaced within the firing chamber and the handgun is again ready to be fired.

What is claimed is:

1. In combination with a semi-automatic handgun which has a barrel mounted within a slide, said barrel terminating in a firing chamber at its inner end, a link pivotally connected by a first pivot pin to said barrel at said inner end, said slide mounted for longitudinal movement upon a handgrip housing, said slide being movable between a cartridge firing position and a cartridge ejecting position, with said slide in said cartridge firing position said barrel having a locking lug assembly which cooperates within a locking recess assembly formed within said slide, said link being pivotally connected by a second pivot pin to said handgrip housing, a trigger connected to said handgrip housing, said trigger to be capable of causing firing of a cartridge located within said firing chamber, the improvement comprising:

a protuberance formed upon said link, a means under a constant biasing force being in continuous contact with said protuberance, with said slide in said cartridge firing position the biasing force of said means being transferred through said protuberance so as to apply a torque in respect to said link tending to maintain said locking lug assembly of said barrel into full cooperation with said locking recess assembly formed within said slide, with said slide in said cartridge ejecting position the biasing force of said means being transferred through said protuberance into said link so as to exert a torque about said link tending to maintain said locking lug assembly disassociated from said locking recess assembly.

2. In combination with a semi-automatic handgun which has a barrel mounted within a slide, said barrel terminating in a firing chamber at its inner end, a link pivotally connected by a first pivot pin to said barrel at said inner end, said slide mounted for longitudinal movement upon a handgrip housing, said slide being movable between a cartridge firing position and a cartridge ejecting position, with said slide in said cartridge firing position said barrel having a locking lug assembly which cooperates within a locking recess assembly formed within said slide, said link being pivotally connected by a second pivot pin to said handgrip housing, a trigger connected to said handgrip housing, said trigger to be capable of causing firing of a cartridge located within said firing chamber, the improvement comprising:

a protuberance formed upon said link, a means under a constant biasing force being in continuous contact with said protuberance, with said slide in said cartridge firing position the biasing force of said means being transferred through said protuberance so as to apply a torque in respect to said link tending to maintain said locking lug assembly of said barrel into full cooperation with said locking recess assembly formed within said slide, with said slide in said cartridge ejecting position the biasing force of said means being transferred through said protuberance into said link so as to exert a torque about said link tending to maintain said locking lug assembly disassociated from said locking recess assembly; and said link having a sleeve, said sleeve having an opening therethrough, said second pivot pin to be conducted through said opening, said opening being eccentrically located with respect to said sleeve, said sleeve being adjustably movable within said link to various positions and fixable in a particular said position by fixing means located within said link.

3. The combination as defined in claim 2 wherein:

the periphery of said sleeve having a plurality of spaced apart notches, said fixing means comprises a pin which is securable within said link and cooperating with any one of said notches.

4. An adjustable link to interconnect the barrel of a firearm to a fixed housing within a firearm, said adjustable link comprising:

a first opening therethrough and a second opening therethrough, said opening being spaced from said second opening, said first opening adapted to cooperate with a first pivot pin to pivotally attach said link to the barrel of a handgun, said second opening to receive a sleeve therein, said sleeve having a third opening therethrough, said third opening being eccentric with respect to said sleeve, said third opening being adapted to cooperate with a second pivot pin to pivotally attach said link to a fixed housing within a handgun, the periphery of said sleeve having a plurality of spaced apart notches, an attaching pin fixedly positioned within said link to cooperate with one of said notches.

5. The link as defined in claim 4 wherein:

a protuberance connected to said link adjacent said second opening and extending radially outward in respect thereto.

6. In combination with a semi-automatic handgun which has a barrel mounted within a slide, said barrel terminating in a firing chamber at its inner end, a link pivotally connected by a first pivot pin to said barrel at said inner end, said slide mounted for longitudinal movement upon a handgrip housing, said slide being movable between a cartridge firing position and a cartridge ejecting position, with said slide in said cartridge firing position said barrel having a locking lug assembly which cooperates within a locking recess assembly formed within said slide, said link being pivotally connected by a second pivot pin to said handgrip housing, a trigger connected to said handgrip housing, said trigger to be capable of causing firing of a cartridge located within said firing chamber, the improvement comprising:

said link having a peripheral surface from which extends a protuberance, said protuberance having a forward edge and a rearward edge, a means under constant biasing force being in continuous contact with said protuberance, with said slide in said cartridge firing position said means being in contact with said forward edge causing a torque level about said second pivot pin tending to maintain said locking lug assembly into full cooperation with said locking recess assembly formed within said slide, with said slide in said cartridge ejecting position said means being in contact with said rearward edge causing a torque to be produced in a direction opposite to the direction of said torque level which tends to maintain said locking lug assembly disassociated from said locking recess assembly.

* * * * *